US006592006B1

(12) United States Patent
Jumel

(10) Patent No.: US 6,592,006 B1
(45) Date of Patent: Jul. 15, 2003

(54) HANDHELD SPRAY DEVICE FOR DISPENSING LIQUID OR FLUID

(75) Inventor: Bernard Marcel Gilbert Jumel, Choisy Au Bac (FR)

(73) Assignee: Beaute Prestige International (FR)

( * ) Notice: Subject to any disclaimer, the term of this patent is extended or adjusted under 35 U.S.C. 154(b) by 0 days.

(21) Appl. No.: 09/553,577

(22) Filed: Apr. 20, 2000

(30) Foreign Application Priority Data

Apr. 23, 1999 (FR) ..... 99 05558

(51) Int. Cl.[7] ..... B67D 5/00
(52) U.S. Cl. ..... 222/78; 222/153.13; 222/321.7
(58) Field of Search ..... 222/78, 153.13, 222/185.1, 189.06, 321.7–321.9; 446/267

(56) References Cited

U.S. PATENT DOCUMENTS

| | | | | |
|---|---|---|---|---|
| 3,029,001 A | | 4/1962 | Blish | |
| 4,424,919 A | * | 1/1984 | Knox et al. | 222/153.13 |
| 4,662,195 A | | 5/1987 | von Buelow et al. | 70/139 |
| 5,261,848 A | * | 11/1993 | Kaplan et al. | 446/74 |
| 5,368,205 A | * | 11/1994 | Groh | 222/189.06 |
| 5,476,198 A | | 12/1995 | Jouillat et al. | 222/328 |
| 5,489,044 A | * | 2/1996 | Ophardt | 222/321.9 |
| 5,666,750 A | * | 9/1997 | Segan et al. | 40/410 |
| 5,887,762 A | * | 3/1999 | Hanna | 222/321.7 |
| 5,906,299 A | * | 5/1999 | Hagleitner | 222/321.7 |
| 5,989,655 A | * | 11/1999 | Meng | 428/13 |

FOREIGN PATENT DOCUMENTS

| | | |
|---|---|---|
| EP | 0 173 885 A2 | 8/1985 |
| EP | 0 444 990 A1 | 2/1991 |

* cited by examiner

*Primary Examiner*—Joseph A. Kaufman
(74) *Attorney, Agent, or Firm*—Lerner, David, Littenberg, Krumholz & Mentlik, LLP

(57) ABSTRACT

In a spray device suitable for being taken hold of and manipulated in the hand, the device comprising a tank of fluid to be sprayed and spray system comprising a spray orifice, pump, and a manual spray-control member, the tank is associated via its bottom portion with a base, the spray system being integrated in the base and being designed in such a manner as to make it possible, in the normal operating position, for the fluid to be sprayed by using the spray system situated beneath the tank. The device is suitable for spraying perfume.

37 Claims, 2 Drawing Sheets

HANDHELD SPRAY DEVICE FOR DISPENSING LIQUID OR FLUID

FIELD OF THE INVENTION

The present invention relates to the technical field of spray devices suitable for being taken hold of and manipulated in the hand by a user who can act on a manual control member to spray the liquid or fluid contained in the tank, for example a perfume.

The present invention relates to a spray device suitable for being taken hold of and manipulated in the hand, comprising a tank of liquid to be sprayed and a spray system comprising a spray orifice, pump means, and a manual spray-control member.

BACKGROUND OF THE INVENTION

In the specific field of perfumery, the oldest and simplest apparatuses for dispensing perfumes made use of a simple flask provided with a single top opening closed by a removable stopper, specifically by screw engagement. Perfume is applied by wetting the stopper in the perfume and in applying the stopper to the skin at the location selected by the user. Such devices suffer from known drawbacks associated with their limited suitability for transport and their poor hermetic sealing which is harmful both for transport and also for proper conservation of the specific characteristics of the perfume.

The conservation of perfumery products was improved by the arrival of apparatuses comprising a flask provided with a dispensing system implementing so-called "bulb pumps". Perfume is distributed by a "Venturi" type system that is not leakproof, and that requires the user to press several times on the bulb pump in order to cause perfume to be expelled in the form of a jet. Those apparatuses are likewise difficult to transport because of their poor sealing. They also suffer from drawbacks in use associated with the relatively sudden expulsion of perfume which in turn implies that perfume tends to be over-consumed.

That is why there has been further technical progress with perfume dispenser apparatuses, mainly in order to control expulsion and dispensing into air of the perfume while improving their suitability for transport. Thus, perfume dispenser systems have appeared which use a flask that serves as a perfume tank, said flask being associated with a gas under pressure (aerosol) for carrying the perfume via a valve so that it leaves the flask in the form of a spray. Such systems have naturally contributed to improving the suitability for transport of perfume flasks designed on that principle because they provide good sealing. However, such apparatuses contribute to increasing the total volume of the device since an auxiliary volume of gas is required and, particularly with flasks that are going to be transported, that constitutes a drawback because of the associated bulk. Furthermore, it turns out that using a gas under pressure to carry a perfume causes the liquid that is to be distributed to accelerate hard, and a relatively large quantity of perfume to be expelled on each squirt. The quantity of perfume used for each squirt is thus relatively large, and in general that is not appreciated by the user. Similarly, environmental protection constraints are factors which limit good acceptance of such apparatuses by consumers because they emit harmful gases into the atmosphere.

Consequently, perfume dispensing devices have been further developed, making use as in all of the above-described apparatuses of a flask provided with an opening in its top portion, which opening receives a spray system having a spray orifice, pump means, and a manual spray-control member. In those apparatuses, the pump means is a pump of conventional type operating by compression and suction with the help of a resilient assembly responsive to the effect of pressure exerted on the manual control member, the pump being connected to the liquid via a dip tube extending over the full height of the storage flask. Spraying is thus normally performed with the spray system situated on top of the perfume tank, the user manipulating the flask with one hand only and pressing on the manual control member with the index finger. Each finger press causes a quantity of perfume to be sprayed, and release of the manual control member sucks in liquid and simultaneously causes the volume of liquid that has been sprayed to be replaced by an equivalent volume of air via the body of the pump.

Spray devices designed on that principle generally give satisfaction, are easy to transport because they are of a design that provides good sealing, and are suitable for being operated comfortably in a manner that is generally appreciated by the user. Nevertheless, such devices suffer from various drawbacks. Firstly, it turns out that the presence of a spray system at the top of the flask gives rise to a series of technical constraints and in particular to the existence of a pushbutton in the top portion of the flask which means that there must be a closure system at this location. In addition to its unattractive appearance, the presence of the closure system constrains the ways in which the flask can be designed. Furthermore, the presence of a dip tube in the flask, in terms of appearance, constitutes an element that is unfavorable to the overall perception of the spray device, unless the spray device is made to be opaque. If it is opaque, then the general display options for the spray device are likewise limited to options in which the liquid cannot be seen directly, and that too can be a factor that is not appreciated by the potential purchaser. Furthermore, the existence of a dip tube usually means that it is difficult to extract all of the liquid when only a small quantity of liquid remains level with the end of the dip tube. Finally, it turns out that the presence of a spray system at the top of a flask or spray device not only limits the ways in which the device can be handled, but also limits options for presentation and three-dimensional configuration of the device by requiring the top portion of the device to have a spray system that is necessary for spraying purposes.

OBJECTS AND SUMMARY OF THE INVENTION

Consequently, the invention seeks to remedy the various drawbacks mentioned above, and to propose a novel spray device suitable for being held and manipulated in the hand, that is of novel design, and of improved configuration.

Another object of the invention is to propose a novel spray device suitable for leading to new presentation options that are partially attractive.

Another object of the invention is to propose a novel spray device of design that is particularly simple and that operates in leakproof manner.

Another object of the invention is to propose a novel spray device which is particularly ergonomic to hold, manipulate, and use.

Another object of the invention is to provide a novel spray device whose operation is particularly safe and reliable.

A further object of the invention seeks to propose a novel spray device which is particularly suited to spraying perfume.

The objects of the invention are achieved by means of a spray device suitable for being taken hold of and manipulated in the hand, the device comprising a tank of fluid to be sprayed and a spray system comprising a spray orifice, pump means, and a manual spray-control member, wherein the tank is associated via its bottom portion with a base, the spray system being integrated in the base and being designed in such a manner as to make it possible, in the normal operating position, for the fluid to be sprayed by using the spray system situated beneath the tank.

BRIEF DESCRIPTION OF THE DRAWINGS

Other details and advantages of the invention are described in greater detail in the light of the following description and illustrative embodiments given solely as non-limiting examples and in which.

MORE DETAILED DESCRIPTION

In the description below, reference is made more particularly to a spray device suitable for being taken hold of and handled in the hand, and constituted by a perfume spray, it being understood that the spray device of the invention is not limited in any way to this type of application. On the contrary the spray device of the invention could be used in other applications wherever there is a need to spray any fluid, in particular a liquid, by the device being taken hold of and manipulated appropriately. Thus, in the meaning of the invention, the term "spray device" should be understood as covering any spray device suitable for being taken hold of and manipulated in the hand and capable of spraying a fluid, regardless of whether it constitutes a perfume spray or a spray usable in related fields, such as cosmetics, or the medical field in particular.

The spray device of the invention and shown in particular in FIGS. 1 to 5 is in the form of a unit that is suitable for being taken hold of in one or both hands and for being manipulated, preferably with one hand only. It comprises a tank 1 of fluid, in particular a liquid, and intended specifically for storing a perfume. The shape of the fluid tank 1 can be arbitrary, it being understood that in the embodiments described purely by way of illustration, the shape given to the tank by way of example is substantially spherical for its top portion, said fluid tank 1 terminating at its bottom end in an open neck 2, e.g. of circular section. The fluid tank 1 can be made equally well out of a plastics material or out of glass, and it can be translucent, transparent, or opaque to light rays, in full or in part.

In accordance with the invention, the fluid tank 1 has its bottom portion associated with a base 3 in which a spray system 4 is integrated and permanently mounted.

Figure 1:
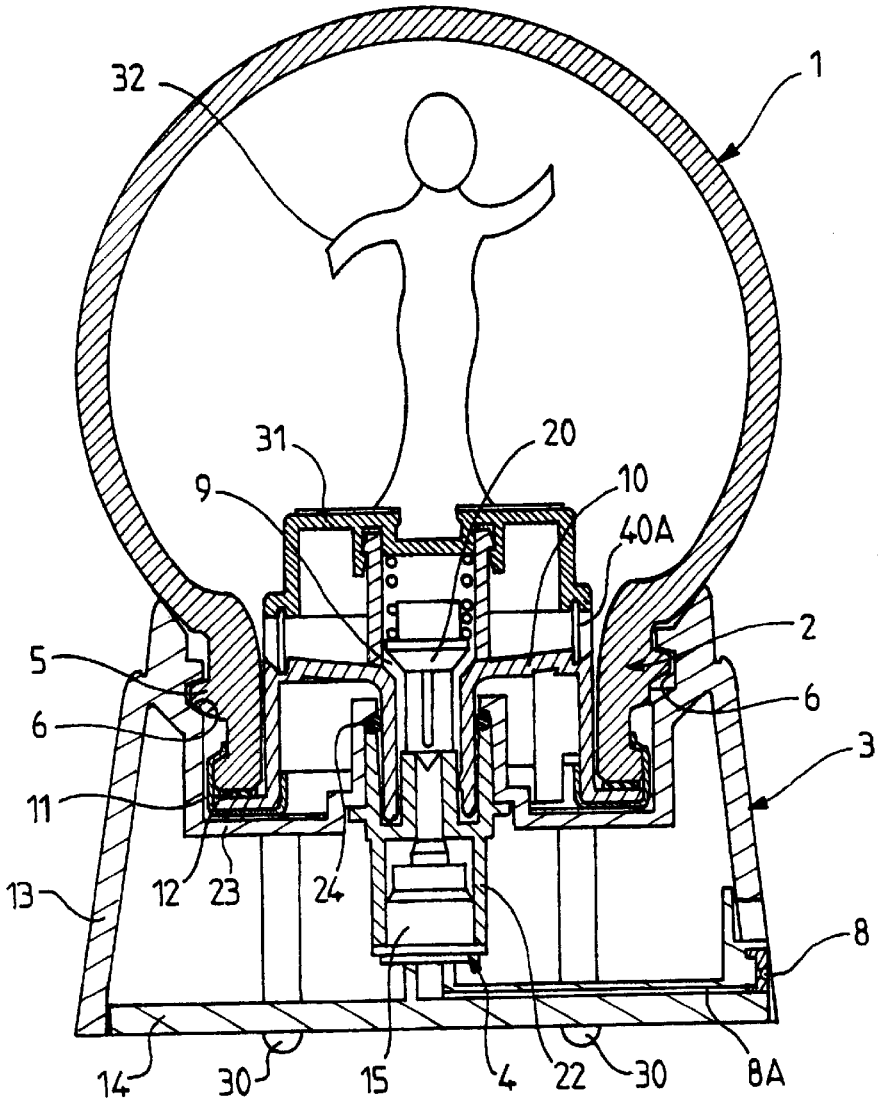
FIG. 1 is a longitudinal section view of a first variant embodiment of a spray device in accordance with the invention.
Figure 3:
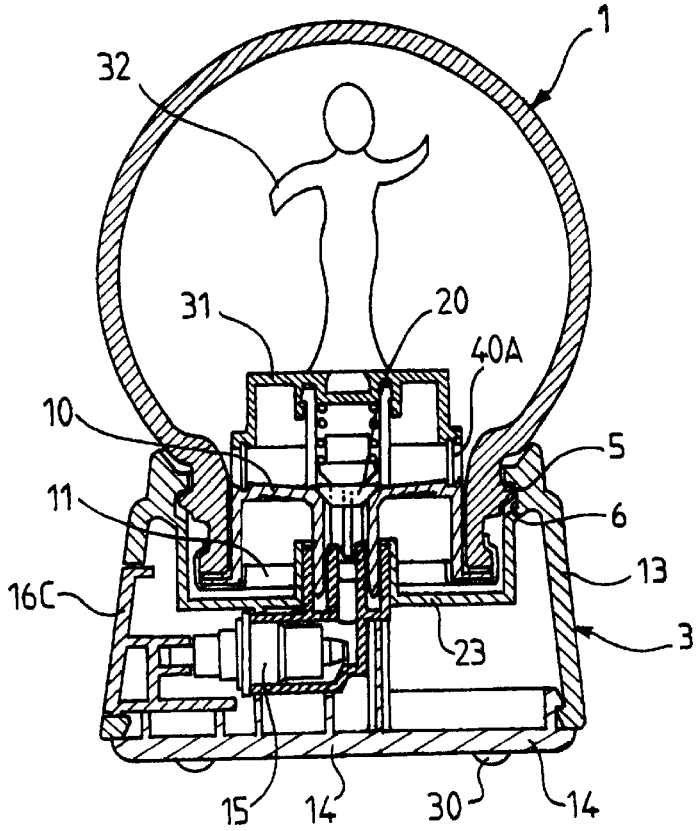
FIG. 3 is a longitudinal section view of a variant embodiment of a spray device of the invention.
Figure 4:
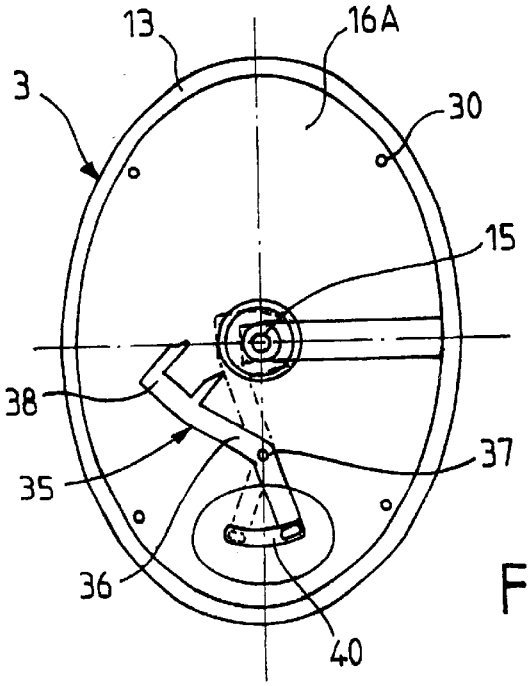
FIG. 4 is a view from beneath showing an implementation detail of the locking member mounted in the base of a spray device of the invention.

In accordance with the invention, and as shown in FIGS. 1 and 3 in particular, the base 3 is advantageously made of a part that is separate from the tank 1, said base 3 being secured to the tank 1 and fixed beneath it in optionally releasable manner. By way of non-limiting example, the tank 1 can be mounted on the base 3 by one or more thread-forming collars 5 projecting radially from the neck 2 co-operating with tapping 6 formed in the top portion of the base 3. Other mounting systems can be envisaged, for example mutual interfitting of the tank 1 and the base 3. Thus, in accordance with a first important characteristic of the invention, the fluid tank 1 is mounted above the base 3 in an upside-down position, i.e. the outlet opening from the tank 1 as defined by the outer edges of the neck 2 points downwards towards the base 3.

Advantageously, the top portion of the tank 1 has no accessories, since the tank 1 is mounted with its outlet orifice pointing down.

Figure 2:
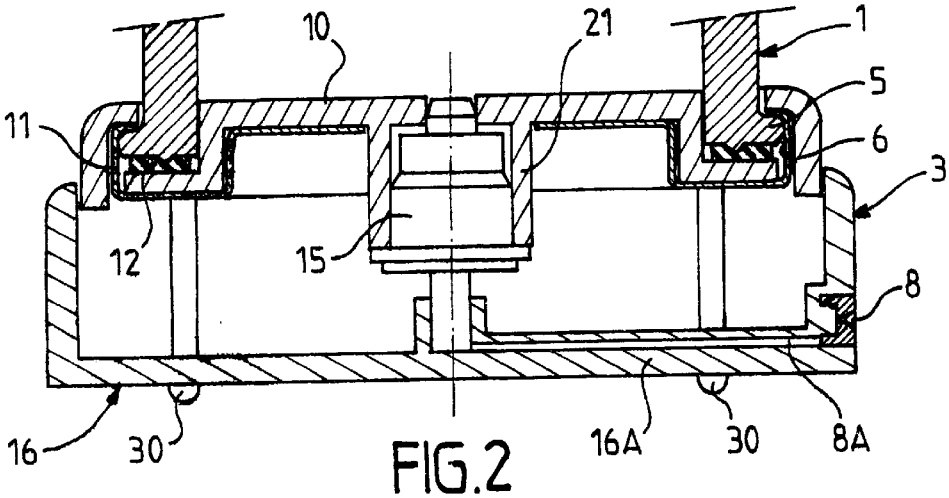
FIG. 2 is fragmentary longitudinal section showing a detail of the base of the invention included in a spray device of the invention.

In accordance with the invention, the tank 1 has a bottom opening defined by the neck 2, said bottom opening being closed in leakproof manner by a floor 10 fitted to the tank 1 and fixed thereto to serve as a linking and connection interface with the spray system 4 via a calibrated orifice 9 formed through its thickness so as to allow fluid to pass therethrough under gravity. As shown in FIGS. 1, 2, and 3, the floor 10 is fixed to the neck 2 by crimping using an annular ring 11, an O-ring 12 being interposed between said crimping ring and the bottom end of the neck 2.

In accordance with the invention, the base 3, e.g. made of a metal or a plastics material, comprises a main body forming a side wall 13 and a bottom wall 14 including at least a substantially plane portion to form a base that is stable when standing on a plane surface. In this way, the spray device of the invention is advantageously suitable for occupying a stable display position on a display unit while also integrating a pushbutton function mounted in its bottom wall 14.

The incorporated spray system 4 organized in the inside volume defined by the base 3 comprises, in conventional manner, a spray orifice 8 secured to the wall 13 and through which the liquid is sprayed to the outside, pump means 15 connected via a channel 8A to the spray orifice 8, and a manual spray-control member 16 that is designed to be actuated by the user to expel fluid.

In accordance with the invention, the spray system 4 of the invention, and in particular the pump means, is designed and organized inside the base 3 in such a manner as to make it possible in the normal operating position as shown in FIGS. 1, 2, and 3, for the fluid to be sprayed using the spray system 4 situated beneath the tank 1, and preferably vertically beneath it.

The term "normal operating position", is used in the invention to mean use of the spray device in a substantially vertical position corresponding to the base 3 and the spray system it contains being positioned beneath the tank 1, with the fluid flowing merely under gravity from the tank 1 to the spray system 4.

Thus, in the invention, the pump means, i.e. the pump 15, is formed by an upside-down pump fed merely under gravity from the tank 1 in such a manner as to present its admission and compression chamber and its spray head 8 located beneath the tank 1 so as to draw fluid into the body of the pump without any risk of leakage when the replacement air enters via the spray orifice 8.

Advantageously, the pump 15 used is an air return pump because the fluid tank 1 used is of the rigid type. Naturally, it is possible to envisage using a so-called "airless" pump, i.e. one that does not return air, providing the fluid tank 1 used is capable of deforming so as to accommodate variation of internal pressure.

Pumps suitable for use in the desired type of geometrical position, i.e. upside-down or head down, can be pumps of the kind commonly available in the trade, such as those referred to as "all position" pumps manufactured by EMSON (registered trademark) or indeed by PFEIFFER (registered trademark) for example, providing they are capable of operating when substantially in the upside-down position.

As shown in the figures, the upside-down pump 15 is mounted in the base 3 beneath the tank 1 and fin direct or indirect relationship with the orifice 9 via a valve member 20 mounted to be resiliently movable via a leakproof reception seat against and on said orifice 9. This type of mount is required and used only when the tank 1 is suitable for refilling.

In a variant embodiment, when the base 3 is not formed by a part that is separate from the tank 1, but on the contrary, it is formed by extending the bottom portion of said tank, the upside-down pump 15 is then mounted in said base-forming bottom portion of the tank 1.

In a first variant embodiment as shown in FIGS. 1 and 2, the upside-down pump 15 is mounted in the base 3 or at the bottom of the tank 1 with its compression and suction axis corresponding to it axial axis of symmetry extending substantially vertically when the device is in its normal operating position which is itself substantially vertical. The pump 15 can be mounted and fixed in a housing 21 formed directly in the floor 10 (FIG. 2) or on the contrary it can be mounted in an intermediate housing 22 fixed on a top partition 23 (FIG. 1) of the base 3, the bottom portion of the pump 15 resting on the bottom wall 14 of the base 3. In the refillable version of the invention, assembly between the neck 2 and the base 3 is sealed by interposing one or more O-rings 24, e.g. interposed between the housing 22 and the floor 10.

The characteristics of pumps that operate by compression and suction are well known to the person skilled in the art and do not form part of the invention as such, and consequently they are not described in further detail herein.

In the invention, the manual spray-control member 16 is mounted on the base 3. In a variant embodiment (not shown in the figures), the manual control member 16 can be integrated in the bottom 14 in the form of a pushbutton that can be actuated axially by the user, and that is movable along the axial axis of symmetry of the pump 15.

In a particularly advantageous version of the invention, as shown in FIG. 2, the manual control member 16 is formed by a push-plate 16A that constitutes the bottom wall of the base 3, said plate being movably mounted so as to be capable of sliding axially relative to the body of the base 3 and being functionally connected to the pump 15. In this variant, the entire bottom portion of the base 3 is thus capable of moving and sliding relative to the remainder of the base 3 or relative to the entire bottom portion of the tank 1.

Advantageously, the body of the base is provided with at least one support member 30 on which he device stands. As shown in FIGS. 1, 2, and 3, the support member 30 is in the form of a set of studs, secured to the base 3 and mounted so as to be fixed relative thereto, said studs passing through openings formed in the push-plate 16A. By means of this disposition, the spray device of the invention can stand freely on a substantially flat support without any risk of the push-plate 16A being actuated accidentally so as to spray a quantity of substance.

The spray device of the invention advantageously further includes a stand 31 which is fixed directly or indirectly on the floor 10 so as to be supported thereby. The stand 31 can thus form a support for carrying one or more decorative members 32 inside the tank 1. The decorative member 32 is preferably implemented in the form of a figurine that is fixed directly to the floor 10, e.g. by means of tabs or lugs.

FIG. 3 shows a variant embodiment of the invention that differs from that shown in FIG. 1 solely in the way in which the pump 15 is mounted. In this variant, the pump 15 is mounted in the base 3 beneath the tank 1 with its compression and suction axis extending substantially perpendicularly to the normal operating position of the device, the axial axis of symmetry of the pump 15 thus extending substantially horizontally. In this variant embodiment, the manual spray-control member 16C is then placed laterally in the walls 13 of the base 3 so as to enable it to be actuated along the operating axis of the pump 15. Apart from this difference in positioning of the pump 15, the other characteristics concerning the mounting of the spray device remain identical.

Advantageously, the spray device of the invention can be provided with locking and unlocking means 35 (FIGS. 4 and 5) for acting on the manual spray-control member 16.

Figure 5:
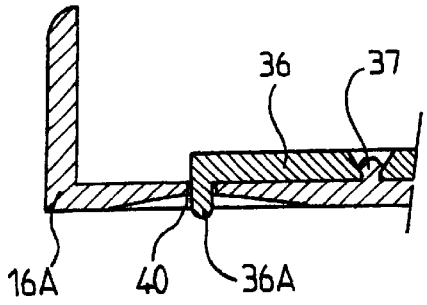
FIG. 5 is a fragmentary section showing an implementation detail of the locking member of the invention.

Advantageously, such locking means are constituted by a lever 36 hinged to move between two abutment positions on the bottom wall 14 or 16A of the base 3. In the abutment position shown in solid lines in FIG. 4, the lever 36 is in its inactive position, i.e. the manual spray-control member 16 is unlocked. In its active abutment position shown in dashed lines in FIG. 4, the head 38 of the lever engages between the push-plate 16A and the bottom portion of the pump 15 so as to prevent any relative displacement between the push-plate 16A and the remainder of the device. This prevents any untimely actuation of the manual spray-control member 16. As shown in FIG. 5, the lever is advantageously mounted inside the base 3, directly on the inside face of the push-plate 16A. In this configuration, the end 36A of the lever 36 is curved so as to pass through a slot 40 formed in the push-plate 16A so as to make it directly accessible to the user.

The spray device of the invention operates as follows.

When the user desires to use the spray device of the invention, the device is taken hold of, generally in one hand, either by putting the thumb under the base 3 with the other fingers holding the top portion of the tank 1, or the other way round, with the thumb being pressed on the top portion of the tank 1. With the locking and unlocking means 35 in the inactive position, the user can then cause a quantity of perfume to be emitted merely by pressing against the push-plate 16A or against the lateral pushbutton 16C.

Consequently, the invention provides a spray device of novel design leading to new options for organization and configuration.

Thus, by leaving the entire top portion of the tank 1 free it is possible to provide a presentation that is particularly attractive and novel for the spray device of the invention since the entire top portion of the device is free and unencumbered.

Furthermore, the absence of any dip tube inside the device, with feed being merely under gravity, provides a design that is simultaneously simple and easy to mount, that is particularly attractive in appearance, and that solves the problem of completely emptying the tank when only a small quantity of liquid remains therein.

The spray device of the invention also makes it possible to use a multiplicity of positions for holding and manipulating the device, thereby facilitating the actions of taking hold of and of manipulating the device, and in particular providing much greater freedom in wrist orientation.

In a variant embodiment, the tank 1 can have a plurality of flakes freely suspended in the liquid to be sprayed so as to constitute an additional decorative element. In such an embodiment, the spray device of the invention advantageously has a filter 40A (FIG. 1), e.g. an annular filter, mounted between the floor 10 and the stand 31 so as to protect the pump 15 by preventing foreign bodies penetrating therein. Other locations and configurations for the filter 40A can naturally be envisaged.

The tank 1 can be removably mounted on the base 3 so as to form a device that can be refilled.

What is claimed is:

1. A spray device for intermittent spray of a fluid and suitable for being held and manipulated by the hand, said spray device comprising: a tank for said fluid including a bottom portion, a base coupled to said tank, said base including a spray orifice, pump means for pumping said fluid through said spray orifice, and a manual spray control member for actuating said pump means, whereby said fluid is fed to said pump means from said tank by means of gravity.

2. A device according to claim 1, wherein said tank is moveably mounted to said base.

3. A device according to claim 1, wherein said bottom portion of said base defines a substantially planar portion for allowing said base to stand stably.

4. A device according to claim 1, wherein said pump means is an upside-down pump.

5. A device according to claim 4, wherein said upside-down pump is mounted in said base beneath said tank, and said upside-down pump includes a compression and suction axis which is oriented substantially vertically.

6. A device according to claim 4, wherein said upside-down pump is mounted in said base beneath said tank, and said upside-down pump includes a compression and suction axis, which is oriented substantially vertically.

7. A device according to claim 4, wherein said upside-down pump is mounted at said bottom of said tank and includes a compression and suction axis oriented substantially vertically in the normal operating position of said device.

8. A device according to claim 1, wherein said manual spray control member is mounted on said base.

9. A device according to claim 8, wherein said manual spray control member is formed by a push-plate forming the bottom of said base, said push-plate being movably mounted relative to said body of the base so as to be capable of sliding axially.

10. A device according to claim 9, wherein the body of said base is provided with at least one support member for supporting said device.

11. A device according to claim 1, including a floor fitted to a bottom opening so as to close said bottom opening in a leakproof manner, said floor serving as a link and including a calibrated orifice acting as a connection interface with said pump.

12. A device according to claim 11 further comprising:

a stand mounted inside said tank and supported by said floor; and a decorative member mounted on said stand.

13. A device according to claim 12, wherein said decorative member is a figurine.

14. A device according to claim 1, wherein said manual spray control member includes a reengaging locking and unlocking means.

15. A device according to claim 1, wherein the top portion of said tank has no accessories.

16. A device according to claim 1, wherein said fluid is perfume.

17. A device according to claim 16, including a plurality of flakes freely suspended in said liquid to be sprayed.

18. A device according to claim 1, wherein said tank is permanently coupled to said base.

19. A device according to claim 1, wherein said tank is removably coupled to said base.

20. A spray device for intermittent spray of a fluid and suitable for being held and manipulated by the hand, said spray device comprising: a tank for said fluid including a bottom portion, a base moveably coupled to said tank, said base including a spray orifice, pump means for pumping said fluid through said spray orifice, and a manual spray control member for actuating said pump means, whereby said fluid is fed to said pump means from said tank by means of gravity.

21. A device according to claim 20, wherein said bottom portion of said base defines a substantially planar portion for allowing said base to stand stably.

22. A device according to claim 20, wherein said pump means is an upside-down pump.

23. A device according to claim 22, wherein said upside-down pump is mounted in said base beneath said tank, and said upside-down pump includes a compression and suction axis which is oriented substantially vertically.

24. A device according to 22, wherein said upside-down pump is mounted in said base beneath said tank, and said upside-down pump includes a compression and suction axis, which is oriented substantially vertically.

25. A device according to claim 22, wherein said upside-down pump is mounted at said bottom of said tank and includes a compression and suction axis oriented substantially vertically in the normal operating position of said device.

26. A device according to claim 20, wherein said manual spray control member is mounted on said base.

27. A device according to claim 26, wherein said manual spray control member is formed by a push-plate forming the bottom of said base, said push-plate being moveably mounted relative to said body of the base so as to be capable of sliding axially.

28. A device according to claim 27, wherein the body of said base is provided with at least one support member for supporting said device.

29. A device according to claim 20, including a floor fitted to a bottom opening so as to close said bottom opening in a leakproof manner, said floor serving as a link and including a calibrated orifice acting as a connection interface with said pump.

30. A device according to claim 29 further comprising:

a stand mounted inside said tank and supported by said floor; and a decorative member mounted on said stand.

31. A device according to claim 30, wherein said decorative member is a figurine.

32. A device according to claim 20, wherein said manual spray control member includes a reengaging locking and unlocking means.

33. A device according to claim 20, wherein the top portion of said tank has no accessories.

34. A device according to claim 20, wherein said fluid is a perfume.

35. A device according to claim 34, including a plurality of flakes freely suspended in said liquid to be sprayed.

36. A device according to claim 20, wherein said tank is permanently coupled to said base.

37. A device according to claim 20, wherein said tank is removeably coupled to said base.

* * * * *

UNITED STATES PATENT AND TRADEMARK OFFICE

CERTIFICATE OF CORRECTION

PATENT NO. : 6,592,006 B1
DATED : July 15, 2003
INVENTOR(S) : Bernard Marcel Gilbert Jumel It is certified that error appears in the above-identified patent and that said Letters Patent is hereby corrected as shown below:

Title page,
Item [57], ABSTRACT,
Line 3, “and spray” should read -- and a spray --.

Column 3,
Line 26, “contrary the” should read -- contrary, the --.

Column 4,
Line 28, “and fin direct” should read -- and in direct --.

Column 25,
Line 45, “which he device” should read -- which the device --.

Signed and Sealed this

Twenty-eighth Day of October, 2003

JAMES E. ROGAN
*Director of the United States Patent and Trademark Office*